US006193562B1

(12) United States Patent
Cheng et al.

(10) Patent No.: US 6,193,562 B1
(45) Date of Patent: Feb. 27, 2001

(54) MOTHER BOARD CONNECTOR OF PUBLIC TELEPHONE

(76) Inventors: Li-Der Cheng, 6F, No. 8, Lane 82, Sec. 7, Chung Shan N. Road, Taipei; Yi-Rong Lee, 7F, No. 382, Hsin Feng Street, Keelung, both of (TW)

( * ) Notice: Subject to any disclaimer, the term of this patent is extended or adjusted under 35 U.S.C. 154(b) by 0 days.

(21) Appl. No.: 09/414,560

(22) Filed: Oct. 8, 1999

(51) Int. Cl.[7] ..... H01R 13/502
(52) U.S. Cl. ..... 439/686; 439/891
(58) Field of Search ..... 439/660, 502, 439/505, 61, 218, 681, 686, 687, 879, 891

(56) References Cited

U.S. PATENT DOCUMENTS

| | | | | |
|---|---|---|---|---|
| 3,251,019 | * | 5/1966 | Cimino | 439/249 |
| 4,582,374 | * | 4/1986 | Conrad et al. | 439/61 |
| 5,103,378 | * | 4/1992 | Stowers et al. | 361/802 |
| 5,741,155 | * | 4/1998 | Herman | 439/502 |

* cited by examiner

*Primary Examiner*—Neil Abrams
*Assistant Examiner*—Michael C. Zarroli

(74) *Attorney, Agent, or Firm*—Bacon & Thomas, PLLC

(57) ABSTRACT

A mother board connector of public telephone is disclosed. The mother board connector includes a first socket base and a second socket base. The first socket base includes a plurality of first socket holes and a plurality of second socket holes on the two opposite ends of the first socket base, respectively, each first socket hole aligned with a respective second socket hole which has a smaller inner radius. A first conducting tube with an outer radius greater than the inner radius of the first socket hole is sleeved into the second socket hole and protrudes out of one end of the second socket hole. The front end of the second socket base includes a plurality of concave holes with respect to the first socket holes. The bottom of the concave hole has a conducting rod connected with a conducting wire to extend the conducting wire out of the second socket base. The concave hole is sleeved with a second conducting tube with an inner radius smaller than the outer radius of the conducting rod. The inner radius of the second conducting tube is the same as the outer radius of the first conducting tube such that the portion of the first conducting tube protruding the first socket base can insert into the spacing between the second conducting tube and the conducting rod to conduct each other when the first socket base is engaged with the second socket base.

2 Claims, 5 Drawing Sheets

MOTHER BOARD CONNECTOR OF PUBLIC TELEPHONE

FIELD OF THE INVENTION

The present invention relates to a mother board connector of public telephone, and more particularly, to a connector structure which allows the terminals to easily insert into the socket hole of the connector and makes the terminals deform the conducting tube in the socket hole such that the axial displacement of the connecting tube in the socket hole is prevented.

BACKGROUND OF THE INVENTION

In the prior arts, public telephone needs conducting wires to connect the key device to the circuit board on the main telephone body such that the signal generated by pressing the key device can be transmitted to the circuit board for sequential communication process. The conducting wire has a terminal connector used to insert into the terminal socket on the circuit board. The terminal connector sometimes has to be disconnected to repair the telephone before the circuit board on the main telephone body is opened. The terminal connector is, then, connected again to the original place to conduct t he power supply after repair work is finished.

FIG. 5 shows a traditional circuit board connector of public telephone. The connector A consists of a first socket A1 and a second socket A2, which have a socket holes A10 and A20, respectively, with almost the same inner radius. The socket holes A10 and A20 are aligned when the first socket A1 and the second socket A2 are engaged and adhered together. A conducting tube B is sleeved into the socket holes A10 and A20, and the back end of the conducting tube B is connected to a conducting wire D, which is partly coated with adhesive material (such as resin) to fix the conducting wire D. The diameter of the conducting tube B should be smaller than the inner radius of the socket hole A10 or A20 so that the side wall of the conducting tube B has radial elasticity and the terminal C may insert into the conducting tube B to be tightly clamped and fixed. The outer brim of the conducting tube B, however, may be deformed by inserting the terminal C into the socket hole A10 with some deviation of degree, thereby the terminal C being not easily inserted into the conducting tube B. The conducting tube B is asserted an axial force when affected by the terminal. The conducting tube B may easily breaks through the adhesive material and protrudes outwards if the adhesion of the adhesive material E and the socket hole A10 is not sufficient so as to make the conducting tube B touch deeper portion of the socket hole A10 and further affect the contact of the terminal C and the conducting tube B. Therefore, the present invention provides an improved mother board connector of public telephone to overcome the above shortcoming in the prior arts.

SUMMARY OF THE INVENTION

The object of the present invention is to provide a mother board connector of public telephone, which may make the terminal easily insert into the socket hole of the connector without deforming the conducting tube.

Another object of the present invention is to provide a mother board connector of public telephone, which may prevent the conducting tube inserted into the socket hole from axially moving due to the asserted force of the terminal, and further avoid ill contact between the terminal and the conducting tube.

The mother board connector of public telephone provided by the present invention includes a first socket base and a second socket base. The first socket base includes a plurality of first socket holes and a plurality of second socket holes on the two opposite ends of the first socket base, respectively, each first socket hole aligned with a respective second socket hole which has a smaller inner radius. A first conducting tube with an outer radius greater than the inner radius of the first socket hole is sleeved into the second socket hole and protrudes out of one end of the second socket hole. The front end of the second socket base includes a plurality of concave holes with respect to the first socket holes. The bottom of the concave hole has a conducting rod connected with a conducting wire to extend the conducting wire out of the second socket base. The concave hole is sleeved with a second conducting tube with an inner radius smaller than the outer radius of the conducting rod. The inner radius of the second conducting tube is the same as the outer radius of the first conducting tube such that the portion of the first conducting tube protruding the first socket base can insert into the spacing between the second conducting tube and the conducting rod to conduct each other when the first socket base is engaged with the second socket base.

Other features and advantages of the invention will become apparent from the following description of the invention which refers to the accompanying drawings.

DETAILED DESCRIPTION OF THE PREFERRED EMBODIMENTS

Figure 1:
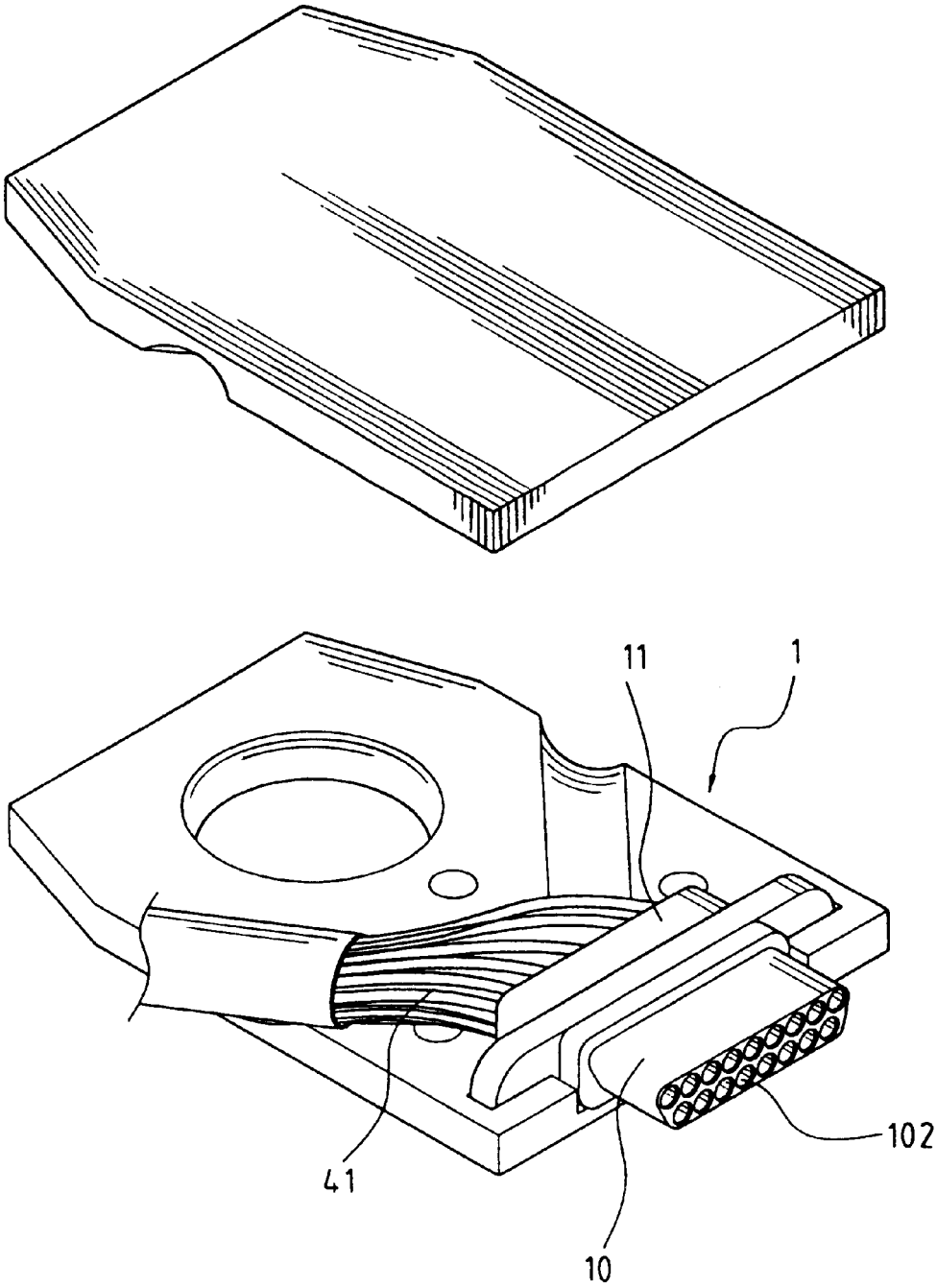
FIG. 1 shows a three-dimensional view of the mother board connector according to the present invention.

With reference to FIG. 1, the three-dimensional view of the mother board connector according to the present invention shows the mother board connector I includes a first socket base 10 and a second socket base 11, and the mother board connector 1 is connected to two outer cases.

Figure 2:
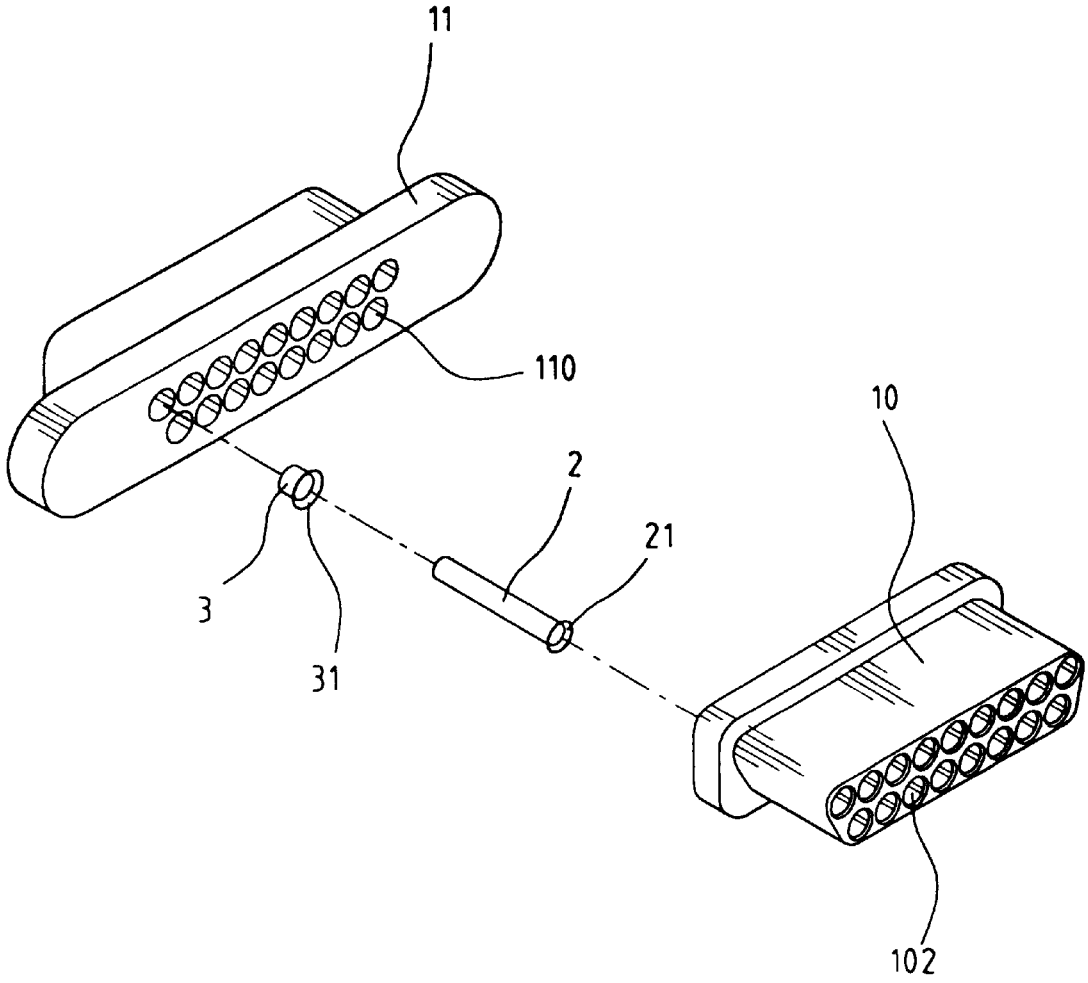
FIG. 2 is a three-dimensional view of the primary parts of the mother board connector according to the present invention.
Figure 3:
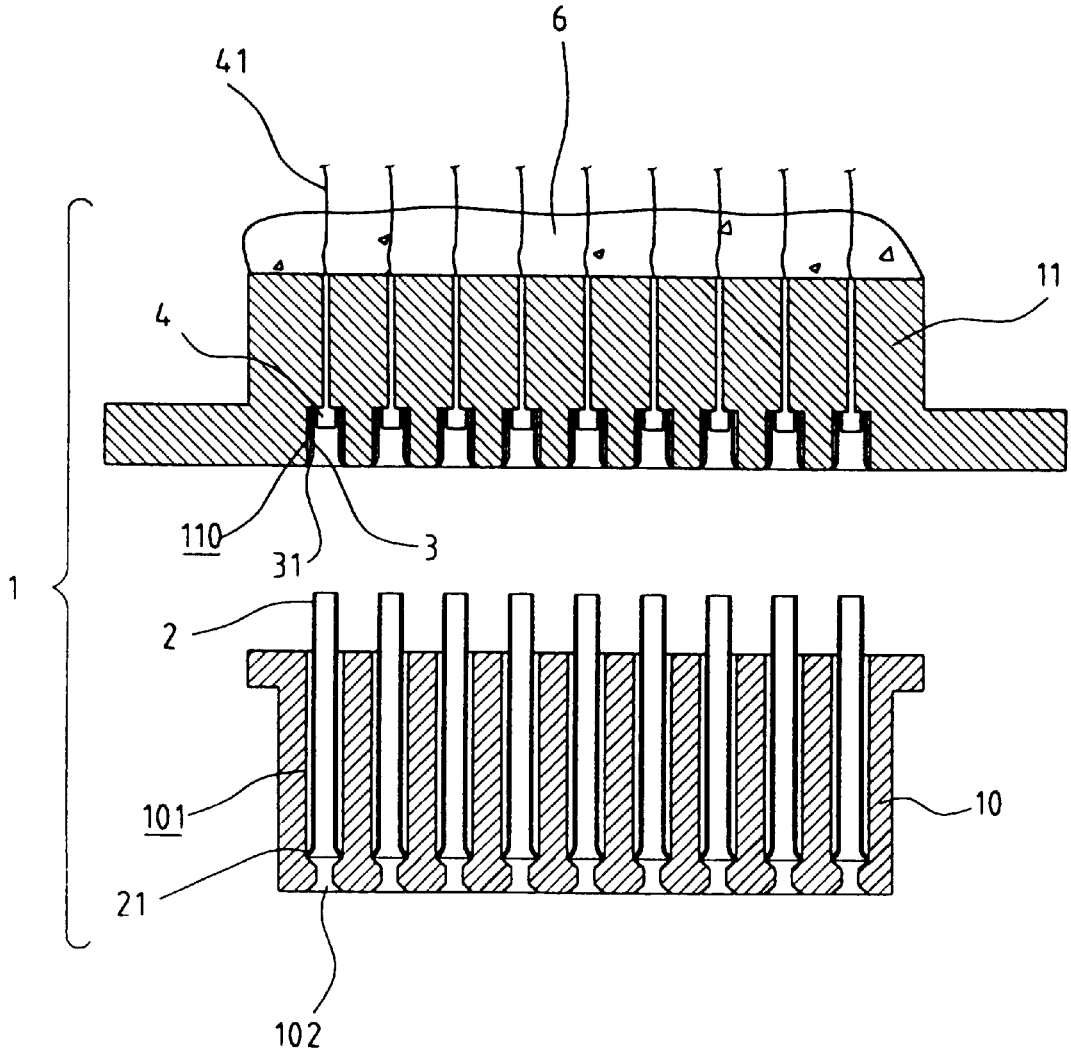
FIG. 3 is a cross sectional discrete diagram of the mother board connector according to the present invention.

With reference to FIG. 2 and 3, the above first socket base 10 has a plurality of first socket holes 101 at the back end, and a plurality of second socket holes 102 at the opposite end with smaller inner radiuses the that of first socket holes 101. The first socket hole 101 and the second socket holes 102 have the same circular center. The second socket base 11 at the front end has a plurality of concave holes 110 with respect to the above first socket holes 101, respectively. The bottom of the concave hole 110 has a penetrating hole which penetrates through the back end of the second socket base 11. One end of the conducting rod 4 forms a plug portion used to insert into the penetrating hole so as to fix the conducting rod 4 on the bottom of the concave hole 110. The plug portion of the conducting rod 4 is connected to a conducting wire 41 to extend the conducting wire 41 out of the second socket base 11. The conducting wire 41 and the plug portion are coated with adhesive material 6 (e.g., resin) to fix the conducting wire 41 and the conducting rod 4. The above first socket hole 101 is sleeved with a first conducting tube 2, which has an outer radius greater than the inner radius of the second socket hole 102 but smaller than the inner radius of the first socket hole 101. Additionally, the first conducting tube 2 has a curved and expanded terminal brim 21 at the front end, and is coordinated with the first socket hole 101 such that the terminal brim 21 of the first conducting tube 2 is toward the second socket hole 102 and the opposite end protrudes out of the first socket hole 101. A second conducting tube 3 is located in the concave hole 110 of the second socket base 11. The outer radius of the second conducting tube 3 is smaller than the inner radius of the concave hole 110, but the inner radius of the second conducting tube 3 is greater than the outer radius of the conducting rod 4 and nearly equal to the outer radius of the first conducting tube 2. The front end of the second conducting tube 3 forms a curved and expanded terminal brim 31.

Figure 4:
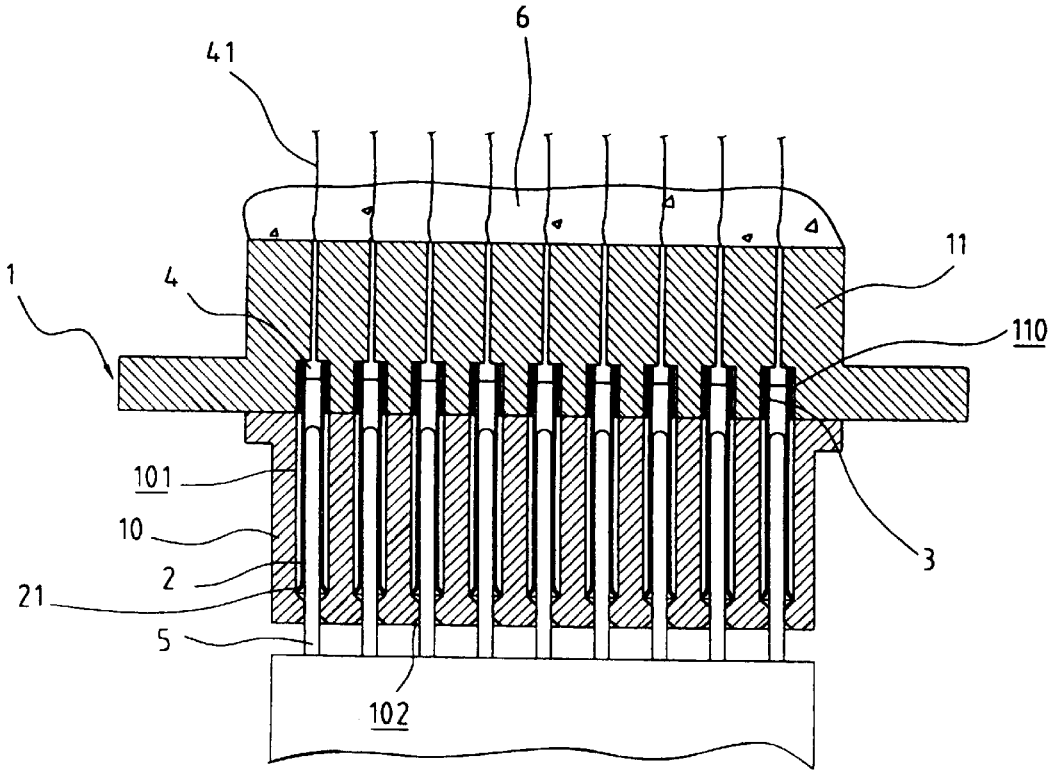
FIG. 4 shows a cross sectional combined diagram of the first socket base and the second socket base illustrated in FIG. 3, with the terminal inserted into the socket hole of the first socket base of the mother board connector according to the present invention.
Figure 5:
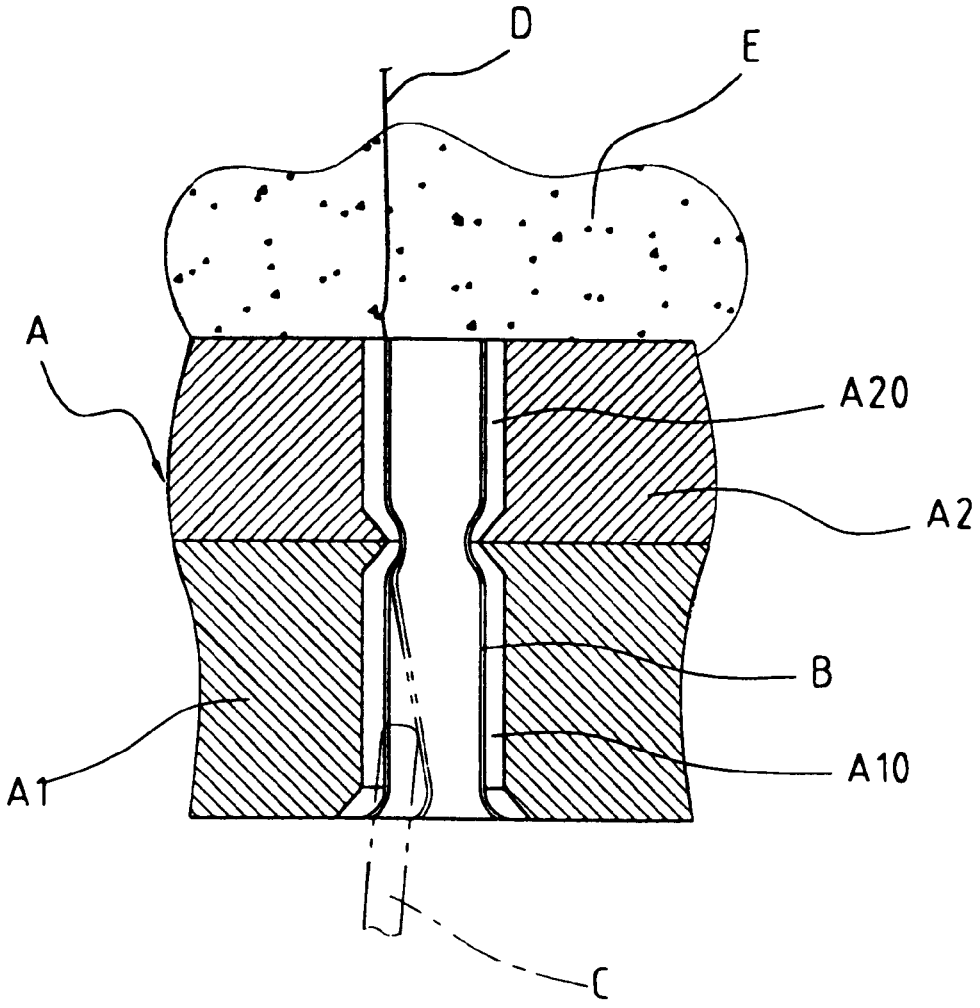
FIG. 5(PRIOR ART)
FIG. 5 shows a cross sectional schematic diagram of a traditional mother board connector in the prior arts.

With reference to FIG. 4, the first conducting tube 2 of the present invention is sleeved into the first socket hole 101 of the first socket base 10. The first socket base 10 and the second socket base 11 are engaged and fixed by adhesion after the second conducting tube 3 is sleeved into the concave hole 110 of the second socket base 11. Therefore, the portion of the first conducting tube 2 protruding out of the second socket base 11 is inserted into the spacing between the inner radius of the second conducting tube 3 and the conducting rod 4 so as to conduct each other. After the first socket base 10 and the second socket base 11 are combined, the terminal 5 is guided by the second socket hole 102 and may always correctly insert into the second socket hole 102 because the terminal brim 21 of the first conducting tube 2 is located at the inner interfacial brim of the first socket hole 101 and the second socket hole 102. Furthermore, the first conducting tube 2 has radial elasticity due to an appropriate spacing between the first conducting tube 2 and the inner radius of the first socket hole 101 such that the terminal 5 is fixed when inserted into the first conducting tube 2. The conducting rod 4 also does not moved axially and protrudes out of the back end of the second socket base 11 because the first conducting tube 2 and the second conducting tube 3 do not moved axially when the terminal 5 is pressed. The first conducting tube 2 and the terminal 5, thus, may keep good contact without any issue for ill contact.

Although only the preferred embodiments of this invention were shown and described in the above description, it is requested that any modification or combination that comes within the spirit of this invention be protected.

What is claimed is:

1. A mother board connector of public telephone, comprising:

a first socket base, which comprises a plurality of first socket holes and a plurality of second socket holes on two opposite ends of the first socket base, respectively, each first socket hole aligned with a respective second socket hole having a smaller inner radius;

a plurality of first conducting tubes, each first conducting tube having an outer radius greater than an inner radius of the first socket hole and sleeved into the second socket hole and protruding out of one end of the second socket hole;

a second socket base, which has a plurality of concave holes at a front end with respect to the first socket holes, a bottom of the concave hole having a conducting rod connected with a conducting wire to extend the conducting wire out of the second socket base; and a plurality of second conducting tubes, each second conducting tube having an outer radius smaller than an inner radius of the concave hole, and having an inner radius greater than an outer radius of the conducting rod, and the inner radius of the second conducting tube equal to the outer radius of the first conducting tube;

wherein a portion of the first conducting tube protruding the first socket base can insert into a spacing between the second conducting tube and the conducting rod to conduct each other when the first socket base is engaged with the second socket base.

2. The mother board connector as claimed in claim 1, wherein a front end of said first conducting tube forms a terminal brim curved and expended outwards and a front end of said second conducting tube forms another terminal brim curved and expended outwards.

* * * * *